United States Patent [19]

Pryor

[11] Patent Number: 4,793,399

[45] Date of Patent: Dec. 27, 1988

[54] HANGER ASSEMBLY

[76] Inventor: John W. Pryor, 420 N. Cedros Ave., Solana Beach, Calif. 92075

[21] Appl. No.: 14,228

[22] Filed: Feb. 12, 1987

Related U.S. Application Data

[63] Continuation of Ser. No. 739,313, May 30, 1985, abandoned.

[51] Int. Cl.[4] ..... A47H 5/00

[52] U.S. Cl. ..... 160/345; 160/123

[58] Field of Search ..... 160/123, 124, 196 R, 160/330, 340, 341, 345, 346, 347, 348, 126, 125; 16/87.2, 87.4 R, 87.6 R, 95 D, 96 D

[56] References Cited

U.S. PATENT DOCUMENTS

| | | | |
|---|---|---|---|
| 1,545,850 | 7/1925 | Reubel | 16/87.6 R |
| 3,098,520 | 7/1963 | Greenstadt et al. | 160/346 |
| 3,105,543 | 10/1963 | Nolan | 160/346 |
| 3,296,651 | 1/1967 | Baker | 160/348 |
| 3,311,158 | 3/1967 | Mason et al. | 160/345 X |
| 3,329,196 | 7/1967 | Algie | 160/341 X |
| 3,460,603 | 8/1969 | Toder | 160/345 |
| 3,616,486 | 11/1971 | Ford et al. | 160/345 X |
| 3,645,318 | 2/1972 | Holzlehner | 160/348 |
| 3,785,005 | 1/1974 | Baker | 160/345 X |
| 3,807,482 | 4/1974 | Baker | 160/348 X |
| 3,928,890 | 12/1975 | Baker | 16/87.2 |
| 3,951,197 | 4/1976 | Cohen et al. | 160/346 |

*Primary Examiner*—Ramon S. Britts
*Assistant Examiner*—David M. Purol
*Attorney, Agent, or Firm*—Brown, Martin, Haller & Meador

[57] ABSTRACT

A hanger assembly for suspending an article or articles such as a curtain or other flexible sheet material below a support rail comprises a series of trolleys for travelling engagement with the support rail, each trolley including a downwardly depending hanger member for suspending the article. Collapsible links are provided between successive trolleys in the assembly to allow them to travel relatively easily around any corners or bends in the support rail.

10 Claims, 2 Drawing Sheets

20
64
38
34
50
36
54
32
46
12
48
56
52
22
44
40
5
30
60
58
62
26
25
29
27
28
23

HANGER ASSEMBLY

This is a continuation of application Ser. No. 739,313 filed May 30, 1985 now abandoned.

BACKGROUND OF THE INVENTION

The present invention relates to an assembly for suspending an article below a support, and is particularly directed to such assemblies which allow travel of the article along the support, which comprises the guide rail or the like. Such hanger assemblies are used, for example, to hang or support articles such as clothes, curtains, and various inventory items.

Such hanger assemblies normally comprise a trolley for travelling along the support rail, a hook or other device for securing to the article to be suspended, and a hanger link for connecting the trolley to the hook. A series of trolleys and connected hooks will be provided along the rail for suspending either a series of articles, or a single article of flexible sheet material such as a curtain.

One specific application of such hanger assemblies is for suspending hospital curtains for surrounding a patient's bed or other area. In this case an overhead rail will travel around the area of the bed, and a curtain will be suspended from a series of trolleys which travel around the rail either to enclose the bed or to pull back the curtain to reveal the bed.

It is a requirement for curtains surrounding hospital beds that a gap is left above the curtains so that water from the fire sprinkler system will reach the enclosed area in the case of a fire. A further benefit of lowering the curtains is that a patient will receive sufficient conditioned air for adequate ventilation when the curtains surround the bed. In the past, this has been done, for example, by suspending the curtains from the overhead trolleys by connecting drop chains of sufficient length to allow an adequate gap above the curtain. The drop chains are secured to the trolleys at one end by means of hooks, and have hooks at the opposite end for hanging the curtains.

One problem in a curtain hanger assembly of this type, and in any hanger assembly where the assembly must travel around corners, is that there is a tendency for trolleys to bind at the corners. If the assembly is supporting curtains, the curtains will tend to bunch up at the corners as a result. Since the curtain support rail will be fairly high, it will be difficult to release the trolleys for smooth travel of the curtains. One way of reducing the tendency of trolleys to bind or jam at the corners of their support rail is to provide drop chain loops between adjacent hanger assemblies. In hospital curtain hanging assemblies this is normally done by providing draw chain loops connecting successive trolley hooks.

Thus, previous hospital curtain hanging assemblies have comprised an overhead rail surrounding the bed, a series of short bodied trolleys in the rail for travel around the bed, a series of hooks each secured to a respective one of the trolleys and a length of metal drop chain secured to the trolley hook with a second hook at the lower end of the drop chain for being secured to the curtain. Metallic draw chains are provided between adjacent trolley hooks in the assembly, to draw the subsequent trolleys at a spaced distance as the curtains are moved around the bed.

There are a number of problems with this type of construction. One is that the metal chains are unsightly. The chains are also difficult to clean. The chains will tend to tangle together during travel, with the draw chains tending to loop over a trolley hook several hangers ahead. This causes problems in untangling the chains.

SUMMARY OF THE INVENTION

It is an object of the present invention to provide a more efficient, sanitary and attractive assembly for suspending an article from a support.

According to one aspect the present invention, a hanger assembly is provided which comprises a series of trolleys for travelling along a support, each trolley having an integral, downwardly- depending, hanger member for supporting a suitable device such as a hook for suspending the articles from the hanger assembly. The suspending device or hook may alternatively be formed integrally with the hanger member. The hanger member in one preferred embodiment of the invention is an elongate rod of relatively stiff material, with an opening at its lower end for supporting a hook.

Preferably successive trolleys in the assembly are connected by collapsible links to reduce the risk of binding in travel around corners in the support rail.

The integral trolley and downwardly depending hanger member may be molded from a plastic material. The collapsible links may be of flexible material to allow them to collapse when the trolleys are pushed together, but in a preferred embodiment of the invention they each comprise a two part hinge, one part for connection to one trolley and the other for connection to the next successive trolley in the rail. The two parts are hinged together at the midpoint, and the hinge preferably incorporates over center protection, so that the two parts will collapse together in one direction only, away from the rail to prevent the hinge from becoming trapped in the rail. The hinge may comprise a so-called "living" hinge, i.e. a reduced thickness portion in a length of platics material. Alternatively it may comprise a suitable pivotal connection between the two parts of the link, with a ridge on one of the parts for engaging the other part to prevent over-centering.

Each trolley preferably has chambers at opposite sides for connection to successive connecting links in the assembly.

The hanger assembly may be designed for suspending any articles which are to be supported below an overhead track or rail. In a preferred embodiment of the invention, the assembly is for support of a flexible sheet of material such as a curtain. Where the assembly is designed for support of hospital curtains, the hanger members are of a suitable length to leave the desired gap above the curtains for ventilation and proper operation of the ceiling fire sprinkler system. The length of the collapsible links between adjacent trolleys when fully extended is the same or less than the spacing between adjacent curtain grommets secured to the hanger members, so that the links will act to pull the curtain around any bends in the track to reduce the risk of binding.

It is therefore an advantage of the present invention that a hanger assembly for suspending an article below a support is provided which travels relatively easily around corners.

It is a further advantage that the assembly is relatively quiet during travel, is unlikely to tangle or bind, and is easy to clean.

It is a still further advantage of the invention that a trolley body incorporates an integral depending link.

BRIEF DESCRIPTION OF THE DRAWINGS

Other objects and advantages of the present invention will become clear from the following detailed description of a preferred embodiment of the invention, taken in conjunction with the accompanying drawings in which like reference numerals refer to like parts, and in which.

DETAILED DESCRIPTION OF THE DRAWINGS

Figure 1:
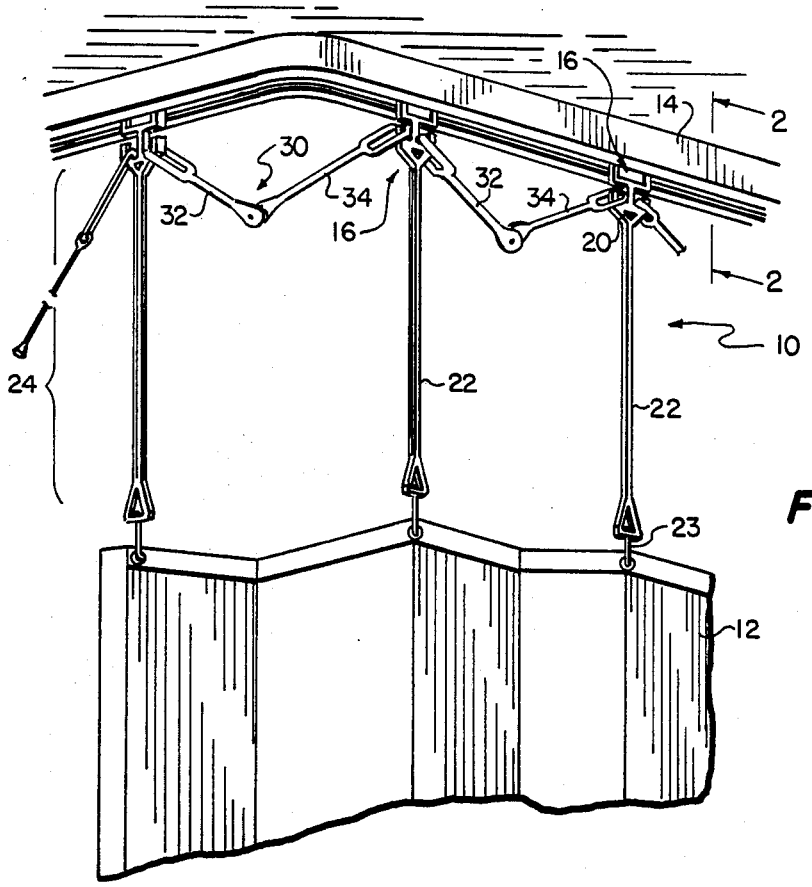
FIG. 1 is a perspective view showing part of a hanger assembly according to a preferred embodiment of the present invention suspending a curtain below an overhead support rail or track.
Figure 2:
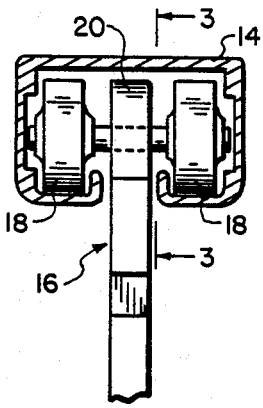
FIG. 2 is a section along the line 2—2 of FIG. 1 showing the engagement of one of the trolleys of the assembly for travel along the support rail.

FIG. 1 of the drawings shows a hanger assembly 10 according to a preferred embodiment of the present invention for suspending an article 12 below a support rail or track 14. In the preferred embodiment described below the suspended article is a sheet of flexible material such as a curtain, or a collapsible pleated curtain, but clearly there are other possible articles which may be suspended by such a hanger assembly, such as clothes and the like, and the invention is not limited to the hanging of curtains.

The hanger assembly 10 basically comprises a trolley 16 having a pair of wheels or rollers 18 supported at opposite sides of the trolley body 20 for travel along the rail 14, and a downwardly depending hanger member 22 formed integrally with the trolley body 20. Each hanger member has a hook 23 pivotally secured at its lower end for hanging part of the curtains, and is of extended length to lower the curtain from the ceiling.

A series of trolleys and downwardly depending hanger members are mounted along the rail 14 as shown in FIG. 1 for securing to spaced points along the upper edge of a curtain or other sheet of flexible material by means of their hooks 23. The hanger members comprise rods of relatively stiff material which is not permanently deformable, and their length is chosen according to the desired spacing 24 between the support rail and suspended article. In the case where the article is a hospital curtain, the spacing 24 will be the spacing required for adequate ventilation and proper operation of the overhead sprinkler system. In this application, the overall assembled length of the trolley body, depending hanger member and track height is of the order of 0.495 meters, or 19.5 inches. This length will lower the curtain away from the ceiling and provide the required 18 inch gap for fire sprinkler water spray.

Figures 4, 5, 6, 7, 8, 9, 10, 11, 12:
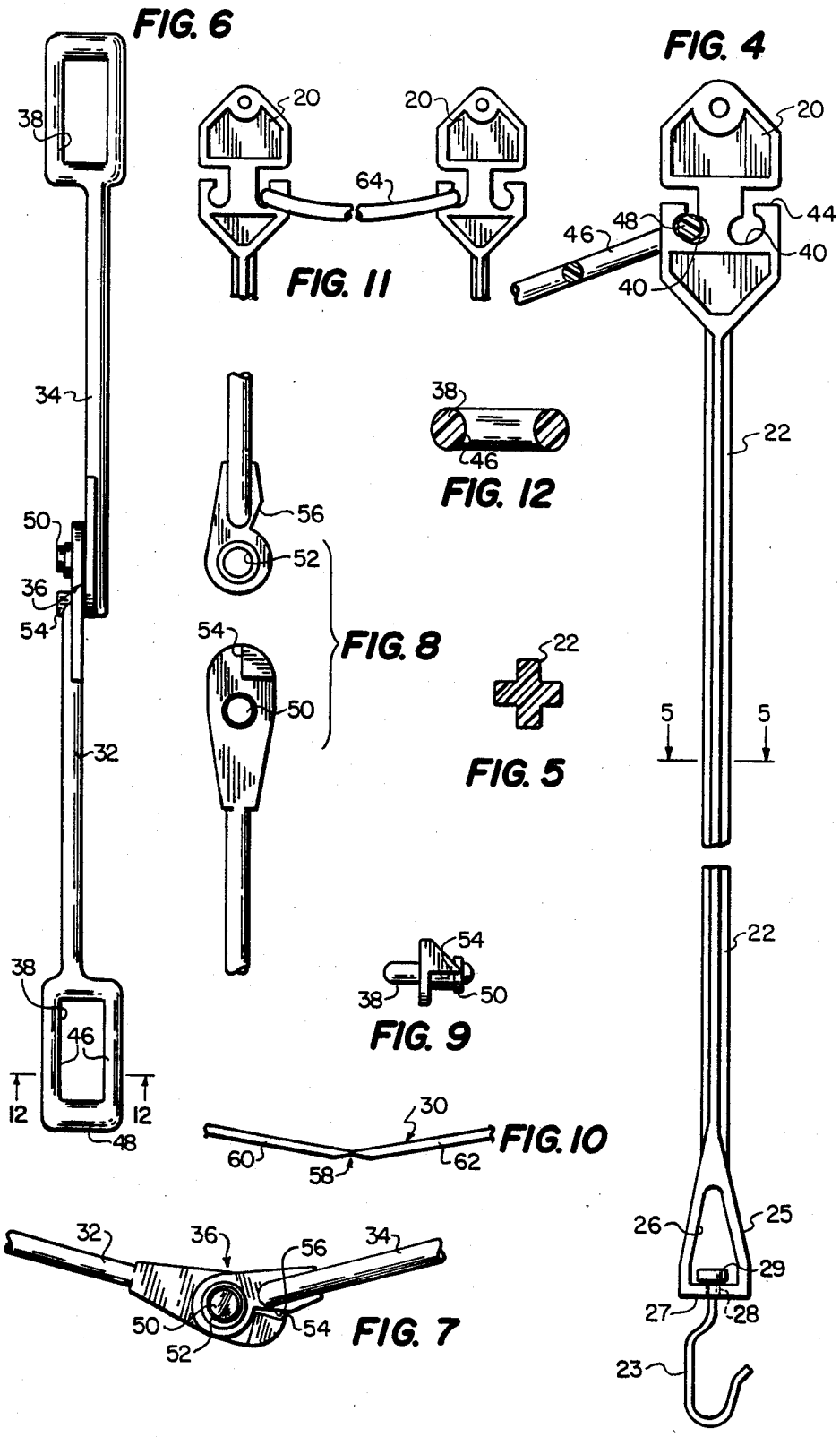
FIG. 4 is a partly broken away front elevational view of a trolley.
FIG. 5 is a section on the lines 5—5 of FIG. 4.
FIG. 6 is a top plan view of a link for connecting two successive trolleys.
FIG. 7 is a detailed front view of the hinge connection between the two parts of the link.
FIG. 8 is a similar view to FIG. 7 showing the hinge parts separated.
FIG. 9 is a top plan view of the lower one of the links shown in FIG. 8.
FIG. 10 is a front view showing an alternative type of hinge.
FIG. 11 shows an alternative type of link between successive trolleys.
FIG. 12 is a cross section on the lines 12—12 of FIG. 6.

As best shown in FIG. 4, each hanger member 22 has a flared portion 25 at its lower end with a transverse chamber 26 projecting through the portion 25 to define a lower flat end wall or seat 27. The seat 27 has a central through bore 28 co-axial with the axis of the hanger member through which the curtain hook 23 projects. The hook has a pivot head 29 at its upper end with a flat undersurface which rests against the seat 27 to allow the hook to pivot or swivel through 360 degrees in the bore 28. The hook is preferably a loose fit in the bore 28 to allow some free play or "wobble" in a sideways direction during travel of the curtains. The hook and head may be separate parts but are preferably formed integrally, with the hook being mounted in the bore by first threading its lower end through the inner end of the bore in the chamber, then pulling the rest of the hook through and rotating it round into its upright orientation with the head engaging the seat 27. It may be a snap fit in the bore. The hook is preferably metallic. In an alternate arrangement the hook may be formed integrally with the lower end of the hanger member.

Each trolley and downwardly depending hanger member are preferably formed integrally from plastics material such as nylon, although other suitable non-metallic or metallic materials may be used. The hanger member may be of cross-shaped section, as shown of FIG. 5. The width of the trolley body 20 is preferably sufficient to ensure that the bodies contact each other before the circumference of the rollers or wheels in adjacent trolleys rub together during travel along the rail, so that opening or closing of the curtains will be relatively friction free and smooth operating.

Figure 3:
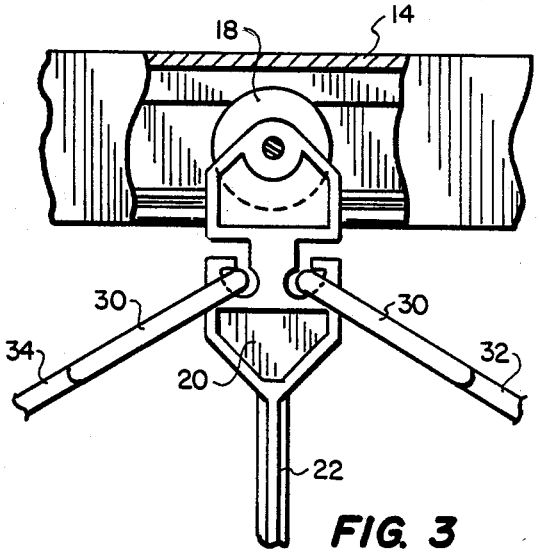
FIG. 3 is a section along the line 3—3 of FIG. 2.

As shown in FIGS. 1 and 3, successive trolleys are connected together by collapsible links 30. Each collapsible link 30 in the preferred embodiment of the invention comprises two parts or arms 32, 34 connected together at the mid-point of the link by a hinge connection 36. As best seen in FIGS. 4 and 6 each part has a square or rectangular section loop 38 at its free end for engagement in a chamber or cavity 40 provided in the trolley body 20. Thus, each trolley body has chambers 40 on opposite sides for connection to successive links in the assembly.

Preferably the trolley hooks 40 and loops 38 on the connecting links are of the form shown in FIGS. 4 and 6, although various alternative shapes for the hooks and connectable loops are possible, or any form of snap connection may be provided between the trolleys and connection links.

In the preferred embodiment shown in FIG. 4 each trolley chamber 40 has a connecting passageway 44 for allowing a loop 38 to snap into the chamber. The passageway 44 is preferably tapered at its entrance end to allow the loop to be inserted relatively easily. The side arms 46 of each loop are narrower than the end 48, as seen in FIGS. 6 and 12, to allow the loop to be inserted into the chamber 40 by passing one of the side arms 46 along the passageway 44 into the chamber, and then twisting the loop round in the chamber until the end 48 is engaged as shown in FIG. 4. The width of thickness of the loop end 48 is such that it cannot be pulled out along the passageway 44. The size of the chambers 40 in the trolley is sufficient to permit the trolley bodies to travel easily around any corners in the support rail 14.

FIGS. 7, 8, and 9 show the hinge connection 36 between the parts of each link 30 in more detail. In this example, the hinge connection comprises a pivot pin 50 on one of the parts 32 which is a snap fit in the opening or bore 52 extending transversely through the end of the part or arm 34. Preferably the hinge connection is such that the link can only collapse downwardly away from the rail 14, to eliminate the risk of the link becoming trapped in the rail. Thus, some form of over-center protection is provided in the connection. In the embodiment shown in FIG. 7 to 9 this comprises a projecting upwardly facing ridge or stop 54 on one of the parts 32 which engages a downwardly facing edge 56 on the other part 34 when the link is in the maximum extended position. In FIG. 7 the links are shown in a position close to the maximum extension allowed, preventing over-centering of the connection. The connecting link may be of any suitable material and is preferably of the same material as the trolleys and depending hanger members.

An alternative type of connecting link 30 is shown in FIG. 10. In this example, the hinge connection 58 between the two parts 60, 62 of the link comprises a so-called "living hinge". In other words, the link comprises a length of plastics material with a substantially central groove or thinned area 58 which is sufficiently thin to act as a hinge. This living hinge is inherently protected against over-centering since it will always tend to bend in the same direction.

Another type of connecting link 64 which may be used in an alternative embodiment of the invention is illustrated in FIG. 11. In this example, the link is hingeless and simply comprises a loop of collapsible flexible material which is engaged in suitable chambers in successive trolleys of the assembly.

The trolley assemblies in FIGS. 10 and 11 are otherwise the same as those shown in FIGS. 1 to 4 and like reference numerals have been used for like parts.

Although the hanger assembly described above includes an elongate hanger member suspending hooks 23 below an overhead rail to lower a curtain from the ceiling, the hanger member may be shortened in alternate embodiments where a spacing is not required. Thus, the flared portion 25 forming the hook seat 27 may be joined directly to the trolley body 20, to form a trolley with an integral hook swivel.

When the hanger assembly described above is used to suspend articles such as curtains below a rail, the assembly will be able to travel relatively easily around corners because of the links between successive trolleys. The length of the collapsible links when fully extended is designed to be the same or less than the spacing between adjacent curtain grommets of a curtain suspended from the assembly, so that the links will tend to pull the curtain around corners. Thus, where the spacing between grommets is about 6 inches, the fully extended length of the collapsible link is preferably about 5½ to 6 inches. There will be relatively little risk of binding, and the successive trolleys and hanger members will not tend to become tangled together because of their unitary construction and the absence of any chains in the assembly. The assembly effectively travels as a single unit with little risk of jamming.

In the preferred embodiment, the entire hanger assembly is of lightweight plastics material, with the exception of the hooks which may be of metal or other suitable material, and is relatively easy and inexpensive to manufacture. The connecting links 32 and 34 preferably snap fit together, so that the mounting and interconnection of the assembly is relatively easy. The hanger assembly is considerably less unsightly than previous assemblies involving metallic chains. The assembly will be relatively tangle free and much easier to clean than chain link hangers, which is particularly important when the assembly is for use in hanging curtains around hospital beds, where a relatively sterile environment is required.

Although a preferred embodiment of the invention has been described above by way of example, it will be understood by those skilled in the field that changes and modifications may be made to the disclosed embodiment without departing from the scope of the invention, which is defined by the appended claims.

What is claimed is:

1. A hanger assembly for suspending a curtain with its upper edge spaced a predetermined distance below a support, comprising:

a series of trolleys, each trolley comprising a trolley body having roller means for traveling engagement in opposite directions in a support, the trolley body having connecting means facing in the opposite directions of travel of the roller means located at a position close to the roller means and including a downwardly depending hanger member extending at least 18 inches from the roller means, the hanger member having suspending means at its lower end for suspending a curtain;

collapsible link means for connecting successive trolley bodies in the assembly and for transmitting pulling force from one trolley body to the next, each collapsible link means comprising first and second elongate arms having adjacent inner ends and outer free ends for releasable connection to successive trolley bodies in the assembly, a hinge connection between the adjacent inner ends of the arms, one connecting means of each trolley body being pivotally connected to the free end of the first arm of one link means and the opposite side connecting means of the trolley body being pivotally connected to the free end of the second arm of the next successive link means in the assembly;

each arm having a loop at its free end and said connecting means of said trolley body comprising chambers at opposite side edges of said trolley body, the loops of each link comprising means for pivotal engagement in the chambers at the adjacent side edges of successive trolley bodies;

each trolley body having a reduced width passageway at each side edge connecting that side edge of the trolley body to the chamber at that side; and each loop comprising side arms and a thickened end portion connecting the arms, the side arms being thin enough to pass along the passageway and the end portion being thick enough to be locked in the chamber when the loop is rotated so that the end portion extends transversely through the chamber.

2. The assembly of claim 1, wherein each trolley and depending hanger member are formed integrally of plastic material.

3. The hanger assembly of claim 1, wherein the suspending means comprise hooks secured to the lower ends of successive hanger members for attachment to spaced points on a curtain.

4. The hanger assembly of claim 1, wherein each hanger member comprises a rod of relatively stiff material.

5. The hanger assembly of claim 1, wherein each trolley body is wider than the roller means in the direction of travel of the roller means to prevent contact between the roller means of successive trolleys in the assembly.

6. The assembly of claim 1, wherein the hinge connection comprises a pivot pin on one arm and the other arm having a transverse opening for snap engagement with the pivot pin.

7. The assembly of claim 6, wherein the hinge connection includes over-center protecting means for allowing collapsing of the link only in a direction away from the support rail.

8. The assembly of claim 7, wherein the over-center protecting means comprises an upwardly facing ridge on one of the arms for engagement with a downwardly facing edge on the other arm to restrict relative pivotal movement of the arms in an upward direction beyond a predetermined position.

9. The assembly of claim 1, wherein the two arms are formed integrally from a length of plastics material and the hinge connection comprises a living hinge formed by a thinned area in the length of material.

10. The assembly of claim 1, wherein said hanger means has a transverse chamber extending through it to define a lower end wall comprising a seat, the lower end wall having a through bore, the hanger means further comprising a hook member having a hook for securing to an article to be supported and an upper end projecting through said bore in said end wall into said chamber, and an integral pivot head at said upper end for pivotally retaining said hook member in said bore and for allowing said hook to swivel 360° in said bore, said hook being threadable through said bore to pivotally secure said hook member in said bore, the upper end of said hook being a loose fit in the bore for allowing some side to side free play of the hook relative to said lower end wall.

* * * * *